US008355662B2

(12) United States Patent
Yonekawa

(10) Patent No.: US 8,355,662 B2
(45) Date of Patent: Jan. 15, 2013

(54) HEAT GENERATING SLEEVE, FIXING DEVICE AND IMAGE FORMING APPARATUS

(75) Inventor: Noboru Yonekawa, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 141 days.

(21) Appl. No.: 12/835,153

(22) Filed: Jul. 13, 2010

(65) Prior Publication Data

US 2011/0013956 A1 Jan. 20, 2011

(30) Foreign Application Priority Data

Jul. 16, 2009 (JP) ..... 2009-167670

(51) Int. Cl.
*G03G 15/20* (2006.01)

(52) U.S. Cl. ..... 399/333; 219/216

(58) Field of Classification Search ..... 399/333, 399/330, 328, 329; 219/216, 617
See application file for complete search history.

(56) References Cited

U.S. PATENT DOCUMENTS

| | | | | |
|---|---|---|---|---|
| 5,520,223 | A * | 5/1996 | Iorio et al. | 138/140 |
| 2002/0141797 | A1* | 10/2002 | Hirst et al. | 399/333 |
| 2005/0031387 | A1 | 2/2005 | Yokoi et al. | |
| 2008/0145116 | A1* | 6/2008 | Tamemasa et al. | 399/329 |
| 2008/0232873 | A1* | 9/2008 | Ueno et al. | 399/333 |
| 2009/0028617 | A1* | 1/2009 | Katakabe et al. | 399/333 |
| 2009/0232567 | A1* | 9/2009 | Baba | 399/329 |
| 2009/0263168 | A1* | 10/2009 | Baba | 399/329 |
| 2009/0317157 | A1* | 12/2009 | Murakami | 399/333 |
| 2010/0196065 | A1* | 8/2010 | Matsuki et al. | 399/329 |

FOREIGN PATENT DOCUMENTS

| | | |
|---|---|---|
| EP | 1 868 041 | 12/2007 |
| JP | 2007-279672 A | 10/2007 |
| JP | 2009-063863 | 3/2009 |
| JP | 2009-075191 | 4/2009 |
| WO | WO 2009/075114 | 6/2009 |

OTHER PUBLICATIONS

Office Action (Notice of Reason for Rejection) dated Apr. 12, 2011, issued in the corresponding Japanese Patent Application No. 2009-167670, and an English Translation thereof.
European Search Report dated Dec. 30, 2010, issued in the corresponding European Patent Application No. 10168875.2-2209.
Office Action (Notification of the First Office Action) dated Dec. 31, 2011, issued in the corresponding Chinese Patent Application No. 201010231217.5, and an English Translation thereof. (10 pages).

* cited by examiner

*Primary Examiner* — Sophia S Chen
(74) *Attorney, Agent, or Firm* — Buchanan Ingersoll & Rooney PC

(57) ABSTRACT

A heat generating sleeve (19) having a high ability to control an amount of heat generation of itself and sufficient strength comprises a heat controlling layer (30) consisting of annealed permalloy, and a main heating layer (31) consisting of unannealed metal plated on a surface of the heat controlling layer (30).

8 Claims, 4 Drawing Sheets

HEAT GENERATING SLEEVE, FIXING DEVICE AND IMAGE FORMING APPARATUS

This application is based on application No. 2009-167670 filed in Japan, the contents of which are hereby incorporated by reference.

FIELD OF THE INVENTION

The present invention relates to a heat generating sleeve, a fixing device and an image forming apparatus.

DESCRIPTION OF THE RELATED ART

It is publicly known that there is, as a fixing device for an image forming apparatus, a fixing device less consuming energy having a heat generating sleeve (belt) with a small heat capacity and capable of increasing its temperature in a short time by inductive heating so as to eliminate a need for preheating on standby.

JP-2007-279672-A discloses a heat generating sleeve having a heat generating layer which consists of a main heating layer (inductively heat generating layer) made from cupper and a heat controlling layer made from magnetic shunt alloy. In the heat generating sleeve, when the magnetic shunt alloy is lower than the Currie temperature, the heat controlling layer of the magnetic shunt alloy as being ferromagnetic catches magnetic flux so as to bias the induced current (eddy current) in the main heating layer by skin effect so as to heat mostly the main heating layer. And, when the magnetic shunt alloy is higher than the Currie temperature, the heat controlling layer consisting of the magnetic shunt alloy as being paramagnetic allows the magnetic flux to pass through so as to lead the magnetic flux to flux suppressing layer disposed inside of the heat generating sleeve, and thereby the amount of heat generation in the heat generating layer is reduced. As described above, if heat generating sleeve is configured to be capable of controlling an amount of heat generation of it self, it is prevented that the portion of the heat generating sleeve where is outside paper feeding area is over heated when the paper feeding area is narrow.

Permalloy (Fe—Ni) is widely used as a magnetic shunt alloy which has a Currie temperature close to a fixing temperature in an image forming apparatus and which is variable widely in magnetic permeability. However, permalloy has a low strength. Therefore, if a heat generating sleeve is made from permalloy, the heat generating sleeve is problematically likely to break. Though permalloy should be annealed to obtain a preferable magnetic property, annealing of the heat generating sleeve causes not only that the strength of the permalloy is lowered but also that the strength of the cupper forming the inductively heat generating layer is also lowered, consequently the heat generating sleeve can not obtain a required strength for a fixing device.

SUMMARY OF THE INVENTION

In view of the above problems, an object of the present invention is to provide a heat generating sleeve which has high ability to control an amount of heat generation of itself and which has sufficient strength, and a fixing device and an image forming apparatus which has a heat generating sleeve prevented from over heating partially.

In order to achieve the objects of the present invention, there is provided a heat generating sleeve comprising a main heating layer made from metal and a heat controlling layer made from permalloy, wherein the heat controlling layer consists of annealed permalloy, and the main heating layer consists of unannealed metal deposited on a surface of the heat controlling layer by plating.

In the heat generating sleeve according to the present invention, the heat controlling layer may be made by plastic forming permalloy in a tubular shape with a bottom and cutting off the bottom. Alternatively, the heat controlling layer may consist of a layer in a tubular shape formed by electrolytic plating of permalloy.

In the heat generating sleeve according to the present invention, the main heating layer may contain nickel.

Further, according to the present invention, it is provided a fixing device which has a heat generating sleeve comprising a main heating layer made from metal and a heat controlling layer made from permalloy, an exciting coil applying an alternating magnetic field to the heat generating sleeve and located outside of the heat generating sleeve, and a pair of rollers pressed to the heat generating sleeve from outside and inside to form a nip, wherein the heat controlling layer consists of annealed permalloy, and the main heating layer consists of unannealed metal deposited on a surface of the heat controlling layer by plating.

The fixing device according to the present invention may further have an auxiliary member which is provided with a flux suppressing layer facing the exciting coil across a protection layer.

Further, according to the present invention, an image forming apparatus is provided with the aforesaid fixing device.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE PREFERRED EMBODIMENT

Figure 1:
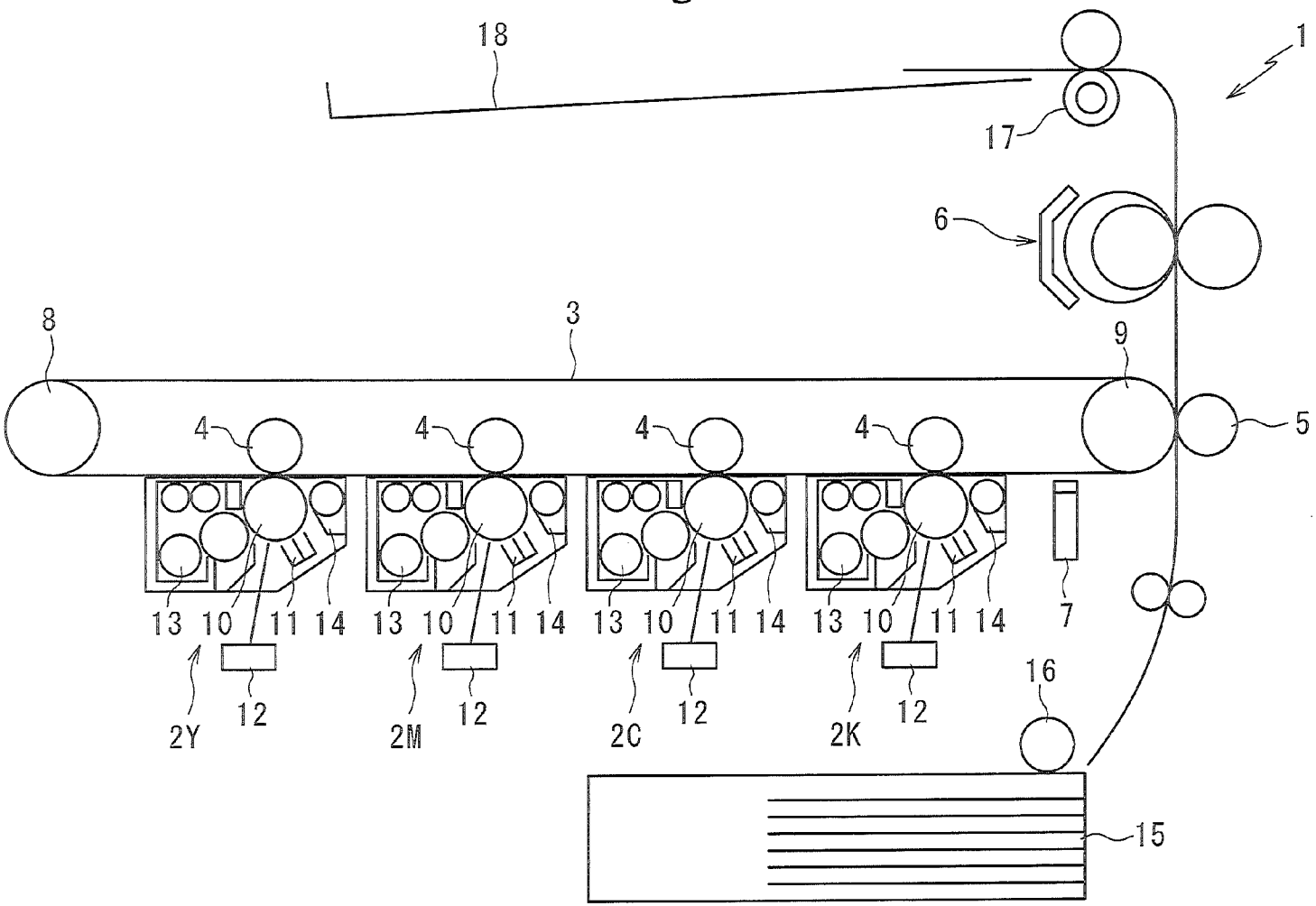
FIG. 1 is a configuration diagram of an image forming apparatus provided with a heat generating sleeve as first embodiment according to the present invention.

FIG. 1 shows an image forming apparatus 1 having a heat generating sleeve as first embodiment according to the present invention.

The image forming apparatus 1 as this embodiment is as a tandem type collar printer having four image forming portions 2Y, 2M, 2C, 2K, which form toner images with respective toner collared in yellow (Y), magenta (M), cyan (C) and black (B), a primary transfer roller 4 which primary transfers the toner images formed by the image forming portions 2Y, 2M, 2C, 2K onto an endless looped intermediate transfer belt 3 by an electrostatic force, a secondary transfer roller 5 which in turn secondary transfer the toner image previously transferred to the transfer belt 3 onto a recording paper by an electrostatic force, and a fixing device 6 which fixes the toner image by heating and pressing the recording paper to melt the toner.

The image forming apparatus 1 has an image density sensor 7 which measures density of the toner image on the intermediate transfer belt 3. The image density sensor 7 also serves as a resister sensor. The intermediate transfer belt 3 is stretched over between a driving roller 8 and free roller 9.

Each of the collared image forming portions 2Y, 2M, 2C, 2K comprises a photoconductor 10, a charger 11 for charging the photoconductor 10, an exposure device 12 for selectively exposing the charged photoconductor 10 to form an electrostatic image, a developing device 13 for developing toner images by feeding toner to the electrostatic image, and a cleaner 14 for scraping off a toner which has failed to be transferred to the intermediate transfer belt 3 and is left on the photoconductor 10.

Further, the image forming apparatus 1 has sheet feeding tray 15 for feeding a recording paper. The recording paper is taken out from the sheet feeding tray 15 sheet by sheet, by a feeding roller 16, to be fed to a nip between the intermediate transfer belt 3 and the secondary transfer roller 5. The recording paper on which the toner image has been fixed by the fixing device 6 is discharged on the receiving tray 18 by a discharging roller 17.

Figure 2:
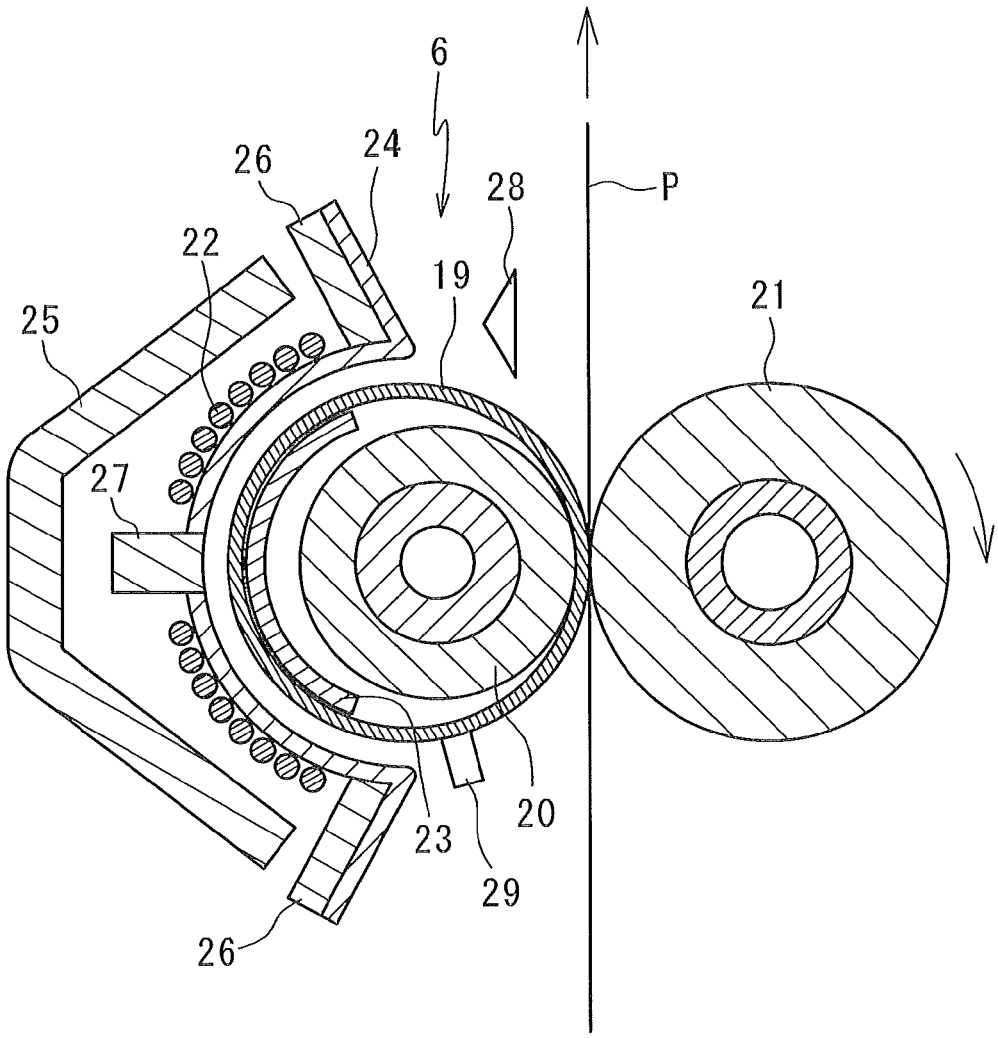
FIG. 2 is a sectional view of a fixing device in FIG. 1.

FIG. 2 shows the configuration of the fixing device 6 in detail. The fixing device 6 has a heat generating sleeve 19 according to the present invention, a fixing roller 20 located inside the heat generating sleeve 19, a pressurizing roller 21 opposed to the fixing roller to interpose a recording paper P so as to form a nip with a certain width for nipping the recording paper P, an exciting coil 22 which is located on the side opposite to the pressurizing roller 21 so as to face to the heat generating sleeve 19 and which applies an alternating magnetic field to the heat generating sleeve 19, and an auxiliary member 23 arranged inside the heat generating sleeve 19 opposite to the exciting coil 22.

The exciting coil 22 is formed of wire wound around a bobbin 24. In three directions in which the heat generating sleeve 19 is not residing around the exciting coil 22, cores 25, 26, 27 are arranged to guide the magnetic flux generated by the exciting coil 22. Further, the fixing device 6 has a separating claw 28 for separating the recording paper P from the heat generating sleeve 19 and a temperature sensor 29 detecting the temperature of the heat generating sleeve 19. The temperature sensor 29 is arranged so as to detect the temperature at a portion of the heat generating sleeve 19 where contacts to the recording paper P and is taken heat away regardless of size of the recording paper P.

The exciting coil 22 is applied from an unshown high-frequency inverter a high-frequency power at 20-40 kHz and at a power of 100-2000 W adjusted in response to the temperature detected by the temperature sensor 29. If the frequency of the high-frequency power is lower than 20 kHz, the efficiency of the heat generation gets down significantly. On the other hand, if the frequency is higher than 40 kHz, the power supply to the heat generating sleeve 19 is tight and so the temperature of the heat generating sleeve 19 can not increase sufficiently. Therefore, such condition is not preferable because it can cause a failure of fixing.

Figure 3:
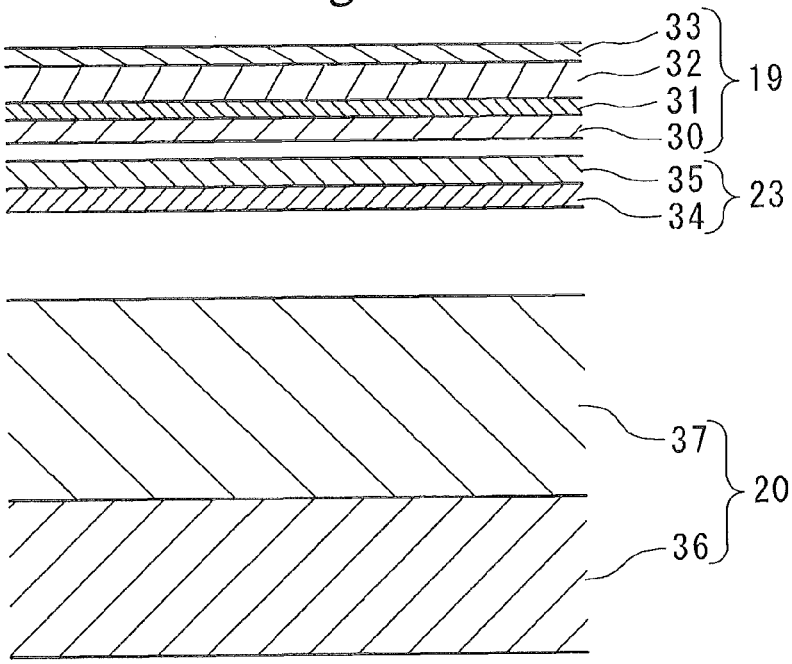
FIG. 3 is enlarged partial sectional view of the fixing device in FIG. 2.

FIG. 3 shows a construction of the heat generating sleeve 19, the auxiliary member 23 and the fixing roller 20. The heat generating sleeve 19 consists of a heat controlling layer 30, a main heating layer 31, an elastic layer 32 and a releasing layer 33, laminated in this order from inside. The auxiliary member 23 has two layers as a flux suppressing layer 34 and a protection layer 35 in this order from inside. The fixing roller 20 has an insulating layer 37 on a circumference of its metal core 36.

The heat generating sleeve 19 is made by forming the heat controlling layer 30, forming the main heating layer 31 on the heat controlling layer 30, further superimposing the elastic layer 32 on the heat controlling layer 30, and finally forming the releasing layer 33 on the elastic layer 32.

The heat controlling layer 30 is made by drawing of a plate of permalloy in a bottomed tubular shape with a side wall having a thickness of 20-200 μm, preferably 30-70 μm, first, and then by cutting off the bottom to form an endless sleeve. Alternatively, the heat controlling layer 30 may be made by plastic forming such as deep drawing and spinning. Also, the heat controlling layer 30 may be formed in a shape of endless sleeve by electrolytic plating to forming layer of permalloy.

The composition of the permalloy is chosen so that the Currie temperature is 150-220° C., preferably, 180-200° C. when the fixing temperature is 170-190° C. and that the volume resistivity at a low temperature lower than the Currie temperature is $2\times10^{-8}$-$200\times10^{-8}\Omega$, preferably, $5\times10^{-8}$-$100\times10^{-8}\Omega$. The permalloy formed in a sleeve shape in turn is annealed to get a relative magnetic permeability of 50-2,000, preferably, 100-1,000 at normal temperature (lower than the Currie temperature).

Figure 4:
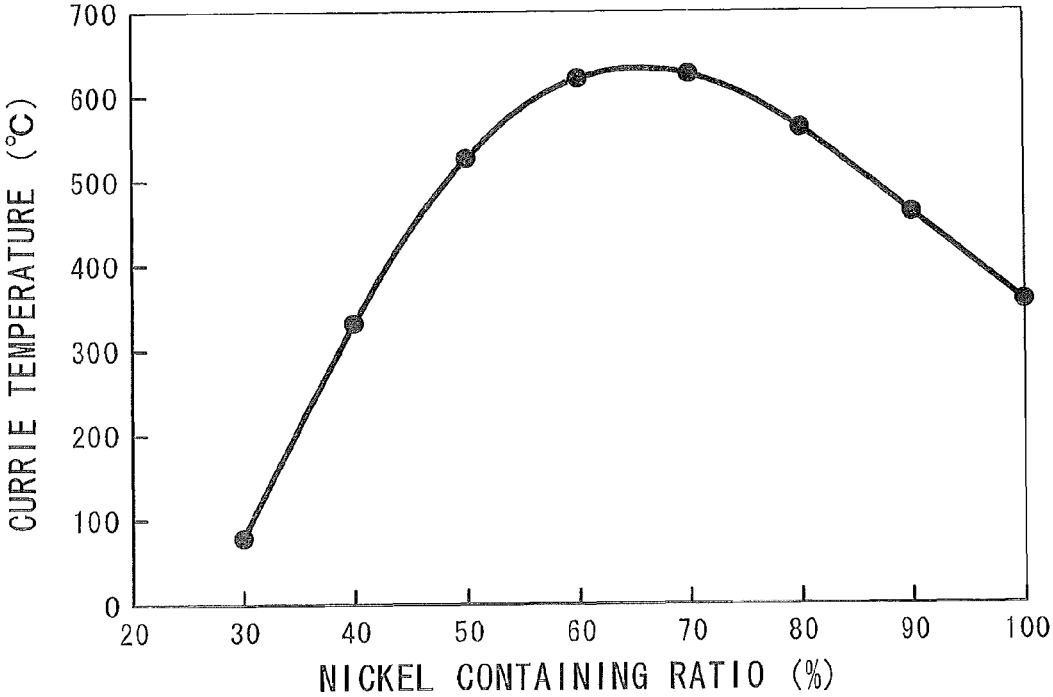
FIG. 4 is a chart representing a relation between content rate of nickel in permalloy and Currie temperature.

If iron contains nickel, as shown in FIG. 4, Currie temperature varies depending on the content rate of nickel. Therefore, a Currie temperature of permalloy can be adjusted by the content rate of nickel. Further, a Currie temperature can be also adjusted by containing of chrome cobalt, molybdenum and the like. Notably, FIG. 4 shows data of Currie temperatures (Tc) of test materials which are formed in a plate-like shapes from permalloy by electrolytic plating and annealed one hour at 800° C., measured by B-H analyzer maid by IWATSU TEST INSTRUMENTS.

Around a circumference of a heat controlling layer 30 made from permalloy by forming in a sleeve shape and annealing, a main heating layer 31 is formed by metal plating. The main heating layer 31 is formed of a much conductive magnetic metal material, preferably from nickel or nickel alloy, specifically having a volume resistivity of $1\times10^{-8}$-$100\times10^{-8}$ Ωm, preferably of $10\times10^{-8}$-$50\times10^{-8}$ Ωm when the heat controlling layer 30 is less than the Currie temperature and a relative magnetic permeability of 20-2,000. The main heating layer 31 made from the above material is preferably formed with a thickness of 5-80 μm.

In the main heating layer 31 formed of magnetic material, a skin effect is strong to flow the eddy current in a restricted range regardless the thickness of the main heating layer 31, therefore the current density is high and the amount of heat generation is large. But, if the main heating layer 31 is formed of magnetic material, a skin effect is weak to flow the eddy current in whole of the main heating layer 31 so that the amount of heat generation tend to be lower. Therefore, in the case where a nonmagnetic material is used to form the main heating layer 31, it is appropriate to form the main heating layer 31 significantly thin so as to make resulted current density high to ensure a sufficient amount of heat generation, even if the eddy current flow spreading throughout the entire main heating layer 31. That means the main heating layer 31 can be made from a nonmagnetic metal material with low resistance such as cupper or argentine with a thin thickness around 5-20 μm.

In contrast, when the heat controlling layer 30 is higher than the Currie temperature, the heat controlling layer 30 with a lowered magnetic permeability can not catch the magnetic flux generated by the exciting coil 22 sufficiently, and therefore allows the magnetic flux to pass through inside of the heat generating sleeve 19. Thereby, the eddy current flowing in the main heating layer 31 are reduced so that the amount of heat generation in the main heating layer 31 gets lower than that when the heat controlling layer 31 is lower than the Currie temperature.

As described above, the heat generating sleeve 19 suppresses an amount of heat generation by itself at the portion where the heat controlling layer 30 has reached to the Currie temperature. Therefore, even if the power inputted to the exciting coil 22 is controlled so as to keep the temperature at the portion where is removed heat from by a recording paper P passed through at a predetermined fixing temperature, the portion where is not removed heat from by a recording paper P is never heated excessively to a temperature causing a problem in the fixing of image.

And, if the main heating layer 31 is formed of copper and the like, an oxidation protection layer preferably is provided between the main heating layer 31 and the elastic layer 32 to prevent the main heating layer 31 from oxidizing. In the case where the main heating layer 31 is formed of copper, an oxidized film grows rapidly and the strength of the oxidized film is very weak, therefore the oxidized film is highly possible to delaminate causing a detachment of the elastic layer 32. Hence, it is required to prevent outer air from contacting to the main heating layer 31 by an oxidation protection layer, so as to allow the adhesion between the main heating layer 31 and the elastic layer 32 described below in detail to be maintained over a long duration.

As a material of the oxidation protection layer, metallic materials completely without air permeability are preferred, and nonmagnetic low resistive material is more preferable to form thinly the oxidation protection layer. Particularly, nickel, chrome and argentine is suitable for the oxidation protection layer, because these can be formed in a thin-wall, and have less influence to a heat generation property and a good adhesiveness to the elastic layer. The oxidation protection layer has a thickness preferably in a range of 0.5-40 μm. Because a thickness less than 0.5 μm can degrade the sealing property with a pinhole, and a thickness more than 40 μm can influence to the heat generating property, particularly to the overheating prevention effect.

Alternatively, polyimide resin and the like can be used as a material of the oxidation protection layer. Polyimide resin is electric insulating material, and therefore never influences to the heat generation property. However, polyimide resin has a slight air permeability in comparison to metallic material, hence the oxidation protection layer has a thickness preferably of 3-70 μm. Because a thickness less than 3 μm with lack of sealing property can allow the oxidized film to grow, and a thickness more than 70 μm is hard to transmit a heat generated in the main heating layer 31 to the outer surface of the fixing roller 20 so that heat efficiency is reduced.

Further, the heat generating sleeve 19 is composed by forming the main heating layer 31 by metal plating and forming the oxidation protection layer as necessary, after that, by forming a elastic layer 32 so as to cover the main heating layer 31. The elastic layer 32 is to transmit a heat uniformly and flexibly to a toner image. Since the elastic layer 32 has an appropriate elasticity, an image noise due to crushing and/or unequal melting of a toner image is prevented.

Therefore, the elastic layer 32 is formed of rubber material or resin material having heat resistance and elasticity, for example, heat resistant elastomer usable at the fixing temperature such as silicone rubber or fluorine rubber. Further, into these materials, various additive agents may be filled for the purpose of adding heat conductivity, reinforcement and so on. As examples of particles added for enhancing heat conductivity, diamond, argentine, cupper, aluminum, marble stone and glass, and more practically, silica, alumina, magnesium oxide, borate nitride and beryllium oxide are recited.

The elastic layer 32 has a thickness of 10-800 μm preferably of 100-300 μm. Because, the elastic layer 32 is difficult with a thickness less than 10 μm to obtain a sufficient elasticity in direction of the thickness, and the elastic layer 32 is difficult with a thickness more than 800 μm to transmit a heat generated in the main heating layer 31 to the outer surface of the fixing roller 20.

The elastic layer 32 has a hardness of 1-80, preferably of 5-30 in JIS hardness. Because, with a hardness in this range, the elastic layer 32 is prevented from degrading in the strength and/or in the adhesiveness and ensures a stable fixing ability. As resins meeting this requirement, silicone rubber of one component, two components or more than two components type, LTV (Low Temperature Vulcanizable) type, RTP (Room Temperature Vulcanizable) type or HTP (High Temperature Vulcanizable) type of silicone rubber, and condensed type or added type of silicone rubber can be used.

Further, the heat generating sleeve 19 is provided with the releasing layer 33 formed on the elastic layer 32. The releasing layer 33 composes the outermost layer of the heat generating sleeve 19 to enhance detachability of the recording paper P from the heat generating sleeve 19. For this releasing layer 33, a material which wears in use at the fixing temperature and which has good detachability for toner is used. For instance, preferred are silicone rubber and fluorine rubber, or fluorine resin such as PFA (tetrafluoroethylene-perfluoroalkoxyethylene copolymer), PTFE (polytetrafluoroethylene), FEP (polytetrafluoroethylene-hexafluoroethylene copolymer) and PFEP (polytetrafluoroethylene-hexafluoropropylene copolymer) and mixture thereof.

The releasing layer 33 has a thickness of 5-100 μm, preferably in a range of 10-50 μm. Further, an adhesion process such as application of primer may be conducted to improve a adhering force between the releasing layer 33 and the elastic layer 32. And, electric conductive agent, abrasion-resistant agent, heat conductive agent and the like may be filled as filler into the releasing layer 33 as necessary.

The flux suppressing layer 34 of the auxiliary member 23 made from a nonmagnetic material having a low resistance of $1\times10^{-8}$-$10\times10^{-8}$ Ωm, preferably of $1\times10^{-8}$-$2\times10^{-8}$ Ωm in volume resistivity, and a relative magnetic permeability of 0.99-2.0, preferably of 0.9-1.1, such as a copper having a width of 0.2-2 mm.

When the heat controlling layer 30 has reached to the Currie temperature, magnetic flux generated by the exciting coil 22 passes thorough the flux suppressing layer 34. Since the flux suppressing layer 34 has a low electric resistivity, a big eddy current flows. This eddy current forms a magnetic field canceling the magnetic flux generated by the exciting coil 22 so as to reduce the magnetic flux density applied to the main heating layer 30 to reduce the amount of heat generation in the main heating layer 30 consequently.

For the purpose of fulfilling a function as the above, it is important that the flux suppressing layer 34 has a lower resistance than the heat controlling layer 30 when the heat controlling layer 30 is higher than the Currie temperature. And the flux suppressing layer 34 may be formed of a material meeting the above condition of volume resistivity and relative magnetic permeability, such as SUS and alumina.

The protection layer 35 of the auxiliary member 23 is a layer provided to protect the flux suppressing layer 34 from frictional abrasion. Therefore, it is preferably made of low friction material containing PFA or PTFE and in a thickness of 10-50 μm.

The metal core 36 of the fixing roller 20 is formed of a metal and the like having sufficient strength and heat resistance to support the heat generating sleeve 19. Thereby, the heat capacity of the metal core 32 is increased. Hence, the fixing roller 20 is provided with the insulating layer 37 around the metal core 36 so that the heat dose not taken away from the heat generating sleeve by the metal core 36.

Accordingly, the insulating layer 37 is formed preferably of a foam of rubber material or resin material having low heat conductivity and heat resistance. Further, if the insulating layer 37 is made from a material having elasticity, a deflection of the heat generating sleeve 19 is allowed and a large width of nip can be maintained. And a double layered structure consisting of a solid body and a foamed body may be employed as the insulating layer 37.

For instance, in the case of using a foamed silicone material as the insulating layer 37, the insulating layer 37 is to be formed with a thickness of 1-10 mm, preferably of 2-7 mm. The hardness of the insulating layer 37 is 20-60 degree, preferably of 30-50 degree in Asker C hardness.

Figure 5:
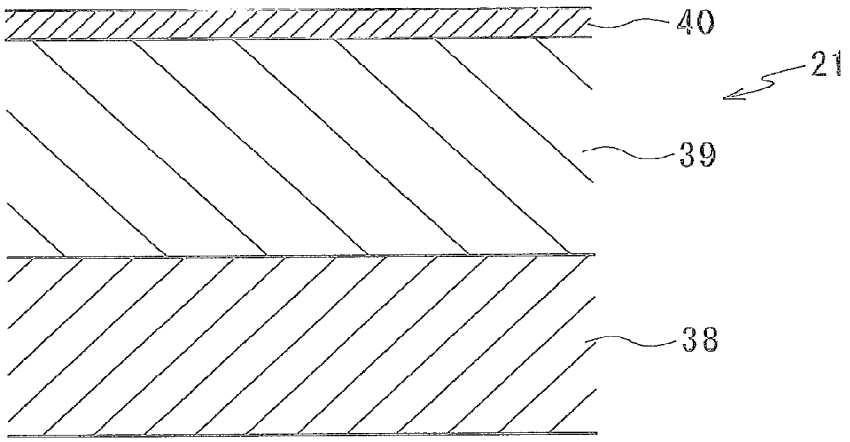
FIG. 5 is a enlarged partial sectional view of a pressurizing roller in the FIG. 2.

FIG. 5 shows the configuration of the pressurizing roller 21. The pressurizing roller 21 is provided an insulating layer 39 on a metal core 38 and a releasing layer 40 further on the insulating layer 39. The metal core 38 is composed of a pipe of aluminum having a wall thickness of 3 mm for example, and if sufficient strength can be ensured, a molded pipe of heat resistive material such as PPS may be used alternatively. It is not impossible to use an iron pipe as the metal core 38, but nonmagnetic one which is insusceptible to electromagnetic induction is more preferable.

The insulating layer 39 of the pressurizing roller 21 is composed of a layer, for instance, of silicone rubber foam with a thickness of 3-10 mm, also may be formed in a configuration double layered consisting of a silicone rubber solid and a silicone rubber foam.

The releasing layer 40 as the outermost layer of the pressurizing roller 21 is to enhance detachability of the pressurizing roller 21 with respect to the recording paper P, similarly to the releasing layer 33 of the fixing roller 20. This releasing layer 40 is preferably formed of fluorinated resin such as PTFE or PFA with a thickness of 10-50 μm.

Notably, in this embodiment, the pressurizing roller 21 is pressed against the fixing roller 20 at a load of 300-500N to form a nip where the heat generating sleeve 19 and the pressurizing roller 20 are pressed to each other with a width of 5-15 mm. If the fixing device 6 is wanted to be used with a different nip width from the present embodiment, pressing load of the pressurizing roller 21 may be adjusted.

As described above, in the fixing device 6, the fixing roller 20 and the pressurizing roller 21 press to the heat generating sleeve 19 from outside and inside to form a nip between the heat generating sleeve 19 and the pressurizing roller 21. In a fixing process, the pressurizing roller 21 is driven in a clockwise direction in the FIG. 2. Thereby, the heat generating sleeve 19 and fixing sleeve 20 is rotationally driven in a counterclockwise direction in the Figure by the frictional force with the pressurizing roller 21. It is noted that the fixing roller 20 may be driven to rotate indirectly the heat generating sleeve 19 and the pressurizing roller 21.

The exciting coil 22 is a coil wound along a longitudinal direction of the heat generating sleeve 19. A cross-section of the exciting coil 22 is, as sown in FIG. 2, formed in a shape curved along the circumference of the heat generating sleeve 19.

In this embodiment, as a winding wire, a litz wire consisting of corded tens to hundreds of fine wire is used. As this exciting coil 22 itself generates a heat due to the resistance of the winding wire when a current is applied, a wire coated with a heat resistive resin is used as the winding wire to maintain its insulation property when the exciting coil 22 heats up. Further, it is preferred to air-cool the exciting coil 22, for instance, with a fan and the like. It is noted that the exciting coil 22 in this embodiment is unbroken in the longitudinal direction.

The cores 25, 26, 27 are arranged to enhance the efficiency of the magnetic circuit and to prevent the magnetic flux from leaking outside. Therefore, the cores 25, 26, 27 are made of a material having high magnetic permeability and a low eddy current loss. Further, it is better to use for the cores 25, 26, 27 a material having a Currie temperature of 140-220° C., preferably of 160-200° C.

If the cores 25, 26, 27 are formed of an alloy having high magnetic permeability such as permalloy, the eddy current loss is likely to increase. Therefore, in the case of using this kind of material, it is preferred that the cores have configurations in which thin plates are layered. Also, a material with magnetic powder dispersed in a resin can be used for the cores 25, 26, 27. Such material has lower magnetic permeability, but it also has an advantage that any shape can be chosen for the cores. If a magnetic shielding of the magnetic circuit of the exciting coil 22 from outside can be achieved, the fixing device 6 may be configured without core (with air core) with omitting the cores 25, 26, 27.

The core 25 has a cross section, as shown in FIG. 2, formed in an arched shape. In this embodiment, the core 25 consists of 13 core pieces having a length of about 10 mm and aligned in the axial direction of the fixing roller 20. The core 26 consists of core pieces having a rectangular formed cross section and a length of 5-10 mm, and arranged on both side of the heat generating sleeve 19. And the core 27 consists of core pieces having a rectangular formed cross section and arranged in a row in an area inside the exciting coil 22 and corresponding to the longitudinal dimension of the heat generating sleeve 19. Moreover, if the cores 25, 26, 27 are integrally formed generally in an "E" shape in its cross section, the efficiency of heat generation is further increased.

Figure 6:
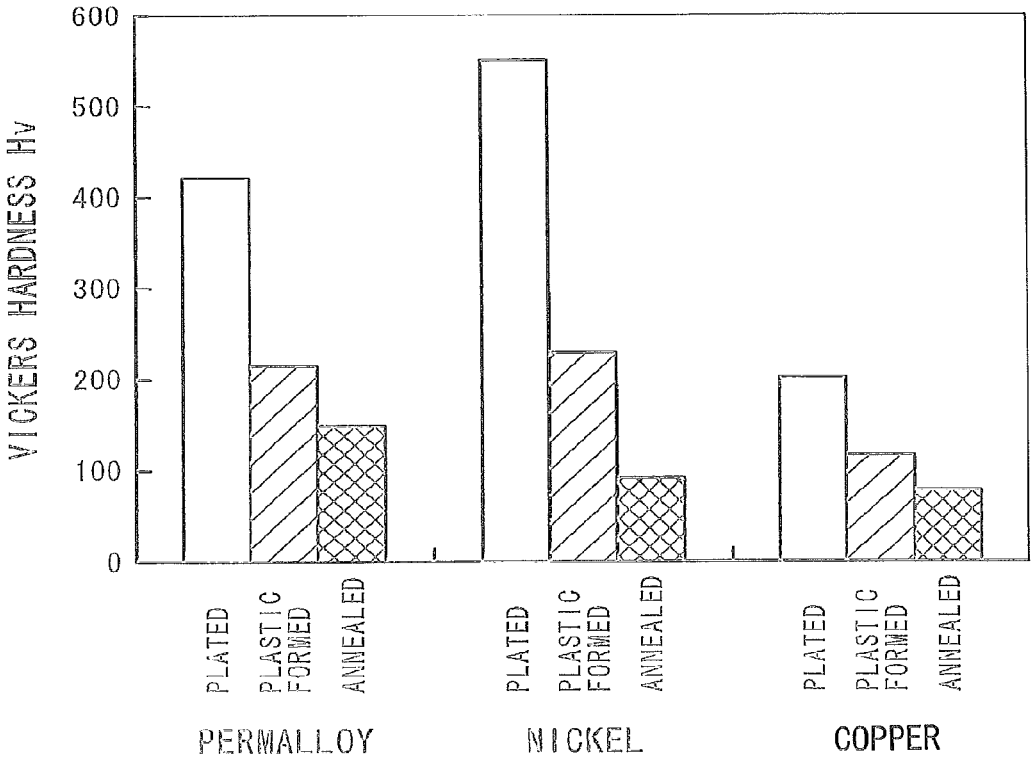
FIG. 6 is a chart representing variance in hardness depending on material and forming method.

FIG. 6 shows a variation of strength of permalloy (with nickel content rate of 34%), pure nickel and copper in response to processing methods. It is noted that with respect to each materials, three test pieces in a same shape are made as an unannealed plated piece which is formed in a predetermined shape by electrolytic plating, an unannealed plastic formed piece which is formed in the predetermined shape by plastic forming and an annealed piece which is subjected an annealed process for one hour at 800° C., and Vickers hardness (Hv) of each test pieces is measured with a Vickers microhardness tester.

Any material shows the highest strength as in the plated piece and the lowest strength as in the annealed piece. In accordance with the present invention, the heat controlling layer 30 is formed of permalloy and provided a preferable magnetic property. After the annealing process, the main heating layer 31 is formed by metal plating, and therefore the strength of the main heating layer 31 is not decreased by an annealing process. Accordingly, the main heating layer 31 compensates for the decreased strength of the heat controlling layer 30 through the annealing process.

Consequently, although the heat generating sleeve 19 performs a high degree of self controlling of the amount of heat generation with the heat controlling layer 30, the heat generating sleeve 19 has a sufficient strength not to break easily even if a deformation is caused to form the nip.

As described above, according to the present invention, there is provided a heat generating sleeve comprising a main heating layer made from metal and a heat controlling layer made from permalloy, wherein the heat controlling layer consists of annealed permalloy, and the main heating layer consists of unannealed metal plated on a surface of the heat controlling layer.

In accordance with this configuration, the heat generating sleeve can be provided with an optimal magnetic property by forming the heat controlling layer of annealed permalloy, and be compensated for a lack of strength by forming the main heating layer as an unanealed plated layer.

In the heat generating sleeve according to the present invention, the heat controlling layer may be made by plastic forming permalloy in a tubular shape with a bottom and cutting off the bottom portion. Also, the heat controlling layer may consist of a layer in a tubular shape formed by electrolytic plating of permalloy.

In accordance with this configuration, the heat controlling layer can be maid by a conventional processing method.

In the heat generating sleeve according to the present invention, the main heating layer may contain nickel.

Nickel and nickel alloy have a preferable magnetic property and electric conductivity, and shows an sufficient strength when is formed in a layer by plating.

Further, according to the present invention, it is provided a fixing device having a heat generating sleeve comprising a main heating layer made from metal and a heat controlling layer made from permalloy, an exciting coil applying an alternating magnetic field to the heat generating sleeve and located outside of the heat generating sleeve, and a pair of rollers pressed to the heat generating sleeve from outside and inside to form a nip, wherein the heat controlling layer consists of annealed permalloy, and the main heating layer consists of unannealed metal deposited on a surface of the heat controlling layer by plating.

In accordance with this configuration, the heat generating sleeve control an amount of heat generation of itself so as not to overheat partially, and has sufficient strength to withstand a deformation for forming a nip. Therefore, the fixing device has a high fixing ability and is less trouble.

The fixing device according to the present invention may further have an auxiliary member which is provided with a protection layer and a flux suppressing layer facing the exciting coil across the protection layer.

In accordance with this configuration, the auxiliary member can catch magnetic fluxes so as to reduce sufficiently the amount of heat generation.

Further, according to the present invention, an image forming apparatus is provided with the aforesaid fixing device.

In accordance with this configuration, the heat generation self control function of the heat generating sleeve provides stability to fixing of images, and the sufficient strength of the heat generating sleeve reduces down time due to brakeage of the heat generating sleeve.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fixing device having a heat generating sleeve comprising a main heating layer made from metal and a heat controlling layer made from permalloy, an exciting coil applying an alternating magnetic field to the heat generating sleeve and located outside of the heat generating sleeve, a pair of rollers pressed to the heat generating sleeve from outside and inside to form a nip, and an auxiliary member which is provided with a protection layer and a flux suppressing layer facing the exciting coil across the protection layer, wherein the heat controlling layer comprises annealed permalloy, and the main heating layer comprises unannealed metal deposited on a surface of the heat controlling layer by plating.

2. The fixing device according to the claim 1 wherein the heat controlling layer is made by plastic forming permalloy in a tubular shape with a bottom and cutting off the bottom portion.

3. The fixing device according to the claim 1 wherein the heat controlling layer consists of a layer in a tubular shape formed by electrolytic plating of permalloy.

4. The fixing device according to the claim 1 wherein the main heating layer contains nickel.

5. An image forming apparatus provided with the fixing device according to the claim 1.

6. The fixing device according to the claim 1 wherein the heat controlling layer consists of annealed permalloy.

7. The fixing device according to the claim 1 wherein the main heating layer consists of unannealed metal plated on a surface of the heat controlling layer.

8. The fixing device according to the claim 7 wherein the main heating layer consists of unannealed metal plated on a surface of the heat controlling layer.

* * * * *